United States Patent [19]

Tsuchida et al.

[11] Patent Number: 4,581,110

[45] Date of Patent: Apr. 8, 1986

[54] METHOD FOR ELECTROPLATING A ZINC-IRON ALLOY FROM AN ALKALINE BATH

[75] Inventors: Toshihiko Tsuchida, Yokohama; Isamu Suzuki, Chigasaki, both of Japan

[73] Assignee: Nippon Surface Treatment Chemicals Co. Ltd., Tokyo, Japan

[21] Appl. No.: 706,397

[22] Filed: Feb. 27, 1985

[30] Foreign Application Priority Data

Feb. 27, 1984 [JP] Japan ..... 59-35820

[51] Int. Cl.[4] ..... C25D 3/56

[52] U.S. Cl. ..... 204/44.2

[58] Field of Search ..... 204/44.2, 123

[56] References Cited

U.S. PATENT DOCUMENTS

| | | | |
|---|---|---|---|
| 2,080,479 | 5/1937 | Hoff | 204/44.2 X |
| 2,080,483 | 5/1937 | Hull | 204/44.2 X |
| 2,080,520 | 5/1937 | Westbrook | 204/44.2 X |
| 4,488,942 | 12/1984 | Martin et al. | 204/44.2 |

*Primary Examiner*—G. L. Kaplan

*Attorney, Agent, or Firm*—Sherman and Shalloway

[57] ABSTRACT

A method for electroplating a zinc-iron alloy from an alkaline bath which comprises electroplating a zinc-iron alloy on a metal surface from an alkaline zinc plating bath having a pH of at least 13.0 and containing 0.02 to 5 g/liter of iron solubilized with a chelating agent, thereby to form on the metal surface a zinc-iron alloy layer having excellent corrosion resistance containing 0.02 to 20% of iron based on the total weight of the deposited metal.

9 Claims, No Drawings

METHOD FOR ELECTROPLATING A ZINC-IRON ALLOY FROM AN ALKALINE BATH

This invention relates to a method for electroplating a zinc-iron alloy from an alkaline bath prepared by dissolving electrodepositable iron in a zincate bath in the presence of a chelating agent.

It is the recent practice to improve zinc electroplated articles in regard to brightness as well as decorative characteristics attributed to chromate coatings. At the same time, they have strongly been required to have high corrosion resistance in order to cope with salt hazards.

Various combinations of zinc with other metals, such as zinc-iron, zinc-nickel, zinc-tin, zinc-manganese and zinc-chromium, have been proposed for use in a zinc electroplating processes intended for producing coatings having high corrosion resistance. Among these, the zinc-iron alloy has attracted particular attention because of its ability to provide excellent corrosion resistance and of the low cost of iron.

Methods for producing steel plates electroplated with a zinc alloy containing iron have been disclosed extensively in the literature and come into commercial acceptance. All of these methods pertain to electroplating from acid baths and are directed to the continuous plating of thin steel plates. They are mainly used to provide primers for coating. Hence, these methods are not suitable for the production of general zinc electroplated articles to be finished in plating shops by applying various chromate coatings.

On the other hand, a method for electroplating a zinc-iron alloy from a pyrophosphoric bath having a pH of 8 to 10 has long been known. But this method is also directed to the production of electroplated steel plates and has not gained commercial acceptance for the production of zinc electroplated articles in general plating shops.

It is well known that in conventional zinc plating methods, the inclusion of iron in plating baths is deleterious because iron acts as an impure metal, and particularly that since the inclusion of several ppm of iron in a zincate bath results in poor brightness, this impure metal should be removed by taking the trouble of treating with zinc dust.

It is an object of this invention to provide a method for electroplating zinc to provide a coating having high corrosion resistance which can permit application of a chromate coating comparable to those on conventional zinc electroplated articles.

The present inventors, upon repeated investigations and experiments, have found that by using a bath prepared by dissolving iron ions electrodepositably in a known zincate bath in the presence of a chelating agent and optionally adding a specified brightening agent to it, it is possible to deposit a zinc-iron alloy coating having high corrosion resistance which can permit application of a uniform bright chromate coating.

Thus, the present invention provides a method for electrodepositing a dense zinc-iron alloy coating having excellent brightness by electroplating a zinc-iron alloy from a bath containing iron ions in a concentration of 0.02 to 5 g/liter which is so high is not conceivable in conventional zincate baths, and optionally containing a selected brightening agent which remains effective even in the presence of iron ions.

The zinc-iron alloy electroplated coating obtained by the method of this invention has a very slow rate of corrosion and exhibits excellent corrosion resistance. The reason for this is not clear, but the present inventors theorize that since an electrodeposited film from an alkaline zinc electroplating bath containing 0.02 to 5 g/liter of electrodepositable iron ions contains 0.02 to 20% by weight of iron, the corrosion potential of the electrodeposited film is higher than that of an electrodeposited coating of zinc alone and therefore the electrodeposited coating obtained in accordance with this invention has a slower rate of corrosion and higher corrosion resistance.

The zinc plated coating containing iron obtained by the method of this invention can be surface-treated with a bright chromate, a colored chromate, a black chromate, a green chromate, etc. as can a pure zinc plated coating free from iron, and this is a characteristic feature not observed in other zinc alloy plated coatings. In addition, the chromate-treated zinc-iron alloy plated coating in accordance with this invention has several times as high corrosion resistance as a conventional chromate-treated pure zinc plated coating.

By taking advantage of the aforesaid feature, the iron-containing zinc alloy plated coating in accordance with this invention may also be applied as an underlayer for the conventional pure zinc plate or as a finish on the conventional pure zinc plate to impart excellent corrosion resistance.

The bath used in the method of this invention is prepared by dissolving electrodepositable iron ions electrodepositably in the presence of chelating agents in a known zincate bath which was developed as a cyanide-free bath for zinc cyanide elecroplating to avoid pollution. The zincate bath used in the bath of this invention usually contains 3 to 40 g/liter of zinc and 30 to 280 g/liter of an alkali hydroxide and is strongly alkaline with a pH of at least 13.0. Depending upon the purpose for which the electroplating is carried out, the zincate bath can be used in different optimal concentration ranges. For example, where a uniform throwing power is important, the desirable concentrations are 3 to 13 g/liter for zinc and 30 to 130 g/liter for the alkali hydroxide. When the current efficiency and operability are important factors in barrel plating, etc., the desirable concentration of zinc is 20 to 40 g/liter and the desirable concentration of the alkali hydroxide is 140 to 180 g/liter.

Because the known zincate bath used as a basic bath in the method of this invention has little ability to dissolve iron ions, it is necessary to add a chelating agent in order to dissolve the required amount of iron ions in the zincate bath. The chelating agent used herein should chelate iron ions to an electrodepositable extent in strong alkalinity at a pH of at least 13.0 and thus permit their stable dissolution, and also should not adversely affect the plating.

Examples of suitable chelating agents used in this invention include hydroxycarboxylic acid salts such as citrates, tartrates, gluconates and glycollates; aminoalcohols such as monoethanolamine, diethanolamine and triethanolamine; polyamines such as ethylenediamine, diethylenetriamine and triethylenetetramine; aminocarboxylic acid salts such as ethylenediaminetetraacetates and nitrilotriacetates; polyhydric alcohols such as sorbitol and pentaerythritol; and thioureas. They may be used either singly or in combination.

In the method of this invention, a coating of iron-zinc alloy is electrodeposited at a temperature of 10° to 35° C. and a current density of 0.1 to 15 A/dm$^2$ on a metal surface from a zincate bath containing electrodepositable iron ions dissolved in it in a concentration of 0.02 to 5 g/liter in the presence of the chelating agent, so that the amount of iron in the coating falls within the range of 0.02 to 20% by weight. The reason for the limitation of the iron content of the electrodeposit is as follows: If the iron content is less than 0.02% by weight, the corrosion resistance of the coating is not much different from that of an electroplated coating of zinc alone. If the iron content exceeds 20% by weight, the corrosion resistance of the coating is reduced and the formation of a chromate coating on it becomes difficult. Thus, in either case, the zinc plated articles cannot gain merchandise values.

Since the bath used in the method of this invention is alkaline, the use of an iron plate as the anode cannot serve to supply the required amount of iron to the bath. Hence, iron should be replenished as an iron compound. The iron compound that can be used for replenishing may, for example, be iron hydroxide, iron sulfate, iron chloride, iron phosphate, iron oxalate, and iron citrate.

The brightening agent optionally used in the bath of this invention may be selected from those used in conventional alkali zincate baths. It should, however, be such that the proportion of iron deposited does not change depending upon the variations of the cathode current density. An example of such a brightening agent is a mixture of 60 to 80% by weight of the reaction product of an amine with an epihalohydrin and 40 to 20% by weight of at least one aromatic aldehyde such as vanillin, heliotropin and anisaldehyde. By adding the brightening agent in a concentration of 0.1 to 5 g/liter to the zincate bath, a zinc-iron alloy electroplated coating having excellent brightness and high corrosion resistance can be obtained with a good throwing power. An especially prefered example of the brightening agent is an aqueous solution containing 0.4 g/cc of a mixture of an aldehyde and the reaction product of diethylenetriamine with epichlorohydrin commercially available under the trade name K-0821 from Nippon Surface Treatment Chemials Co., Ltd.

The following non-limitative Examples illustrate the present invention more specifically.

| | | |
|---|---|---|
| Bath composition | | |
| Zinc oxide | 40 g/liter | (32 g/liter as Zn) |
| Sodium hydroxide | | 140 g/liter |
| Ferric hydroxide | 2 g/liter | (1.26 g/liter as Fe) |
| Triethanolamine | | 10 g/liter |
| Ethylenediamine/epichlorohydrin reaction product | | 3 g/liter |
| Anisaldehyde | | 1 g/liter |
| Plating conditions | | |
| pH | | 14 |
| Temperature | | 25° C. |
| Cathode current density | | 3 A/dm$^2$ |

A zinc-iron alloy was electrodeposited to a thickness of 5 micrometers on a polished steel plate (50×150×0.3 mm) under the above conditions from an iron-containing zincate bath of the above composition. The appearance of the electroplated coating was uniform and bright and comparable to an electrodeposited coating obtained from a conventional zinc plating bath. The coating contained 5% by weight of iron.

The corrosion resistance of the iron-containing electroplated coating was compared with that of a conventional zinc electroplated coating (5 micrometers thick) by a salt spray test (JIS Z-2371). The time which elapsed until red rust occurred was 112 hours for the iron-containing coating but 64 hours for the conventional zinc electroplated coating. These results demonstrate the better corrosion resistance of the zinc-iron alloy electroplated coating.

EXAMPLE 2

| | |
|---|---|
| Bath composition | |
| Zinc oxide | 10 g/liter (8 g/liter as Zn) |
| Sodium hydroxide | 100 g/liter |
| Ferrous sulfate | 0.5 g/liter (0.01 g/liter as Fe) |
| Triethylenetetramine/epichlorohydrin reaction product | 5 g/liter |
| Vanillin | 2 g/liter |
| Plating conditions | |
| pH | 14 |
| Temperature | 25° C. |
| Cathode current density | 3 A/dm$^2$ |

An iron-containing zinc alloy coating having a thickness of 5 micrometers was electrodeposited on a polished steel plate (50×150×0.3 mm) under the above conditions from an iron-containing zincate bath of the above composition. The coating was treated with a colored chromate (JASCO LOWMATE #62, a trade name for a product of Nippon Surface Treatment Chemicals Co., Ltd.; 10 cc/liter, 25° C., 10 seconds). A beautiful chromate coating comparable to a colored chromate coating on a conventional zinc plated coating could be obtained.

The resulting iron-containing zinc alloy coating having the colored chromate coating on it was compared in corrosion resistance with a zinc electroplated coating having a thickness of 5 micrometers prepared from the conventional zincate bath and subjected to the same colored chromate treatment as above, by the salt spray test (JIS Z-2371). The results are shown in Table 1. These results demonstrate that zinc-iron alloy coating of the invention having the colored chromate coating thereon (sample I) had much higher corrosion resistance than the conventional zinc plated coating having the colored chromate coating (sample II).

TABLE 1

| Sample | Time elapsed until black spots occurred (hours) | Time elapsed until white rust occurred (hours) | Time elapsed until red rust occurred (hours) |
|---|---|---|---|
| (I) | 72 | 312 | 1682 |
| (II) | 72 | 144 | 240 |

EXAMPLE 3

| | |
|---|---|
| Bath composition | |
| Zinc oxide | 30 g/liter (24 g/liter as Zn) |
| Sodium hydroxide | 150 g/liter |
| Ferrous oxalate | 0.8 g/liter (0.25 g/liter as Fe) |
| Diethanolamine | 30 g/liter |
| K-0821 (brightening agent made by Nippon Surface Treatment Chemicals Co., Ltd.) | 6 cc/liter |

-continued

| Plating conditions | |
|---|---|
| pH | 14 |
| Temperature | 28° C. |
| Cathode current density | 2.5 A/dm$^2$ |

A zinc-iron alloy coating having an average thickness of 5 micrometers was electrodeposited on a polished steel plate (50×150×0.3 mm) under the above conditions from a bath having the above composition. The alloy coating consisted of 99.0% by weight of zinc and 1% by weight of iron. The coating was subjected to the same colored chromate treatment as in Example 2 to give a bright beautiful chromate coating.

The resulting zinc-iron alloy coating having the colored chromate coating on it (sample I) was compared in corrosion resistance with a zinc plated coating having an average thickness of 5 micrometers prepared from a conventional zinc cyanide plating bath and subjected to the same colored chromate treatment as above (sample II) by the salt spray test in accordance with JIS. The time which elapsed until red rust occurred was 1824 hours for sample (I) and 264 hours for sample (II), and the sample (I) in accordance with this invention showed about 7 times as high corrosion resistance as sample (II).

EXAMPLE 4

| Bath composition | |
|---|---|
| Zinc oxide | 15 g/liter (12 g/liter as Zn) |
| Sodium hydroxide | 130 g/liter |
| Ferrous sulfate | 3 g/liter (0.60 g/liter) |
| Ethylenediaminetetraacetate | 30 g/liter |
| K-0821 (brightening agent) | 5 cc/liter |
| Plating conditions | |
| pH | 14 |
| Temperature | 25° C. |
| Average cathode current density | 0.5 A/dm$^2$ |

Under the above conditions, 100 test pieces (bolts having a diameter of 10 mm, and a length of 30 mm) were subjected to barrel plating from a bath of the above composition in a small-sized barrel to obtain a smooth, bright zinc-iron alloy electroplate having an average thickness of 3 micrometers. The alloy electroplated coating consisted of 96% of zinc and 4% by weight of iron. The alloy coating was subjected to the same colored chromate treatment as in Example 1 to give a chromate coating (I) having a beautiful interference color.

A zinc electroplated coating from the conventional zincate bath was subjected to the same colored chromate treatment as above to form a chromate coating (II). The corrosion resistance of the chromate coating (I) was compared with that of the chromate coating (II) by the salt spray test in accordance with JIS. The time which elapsed until red rust occurred was 1104 hours for (I), but 144 hours for (II).

EXAMPLES 5–9

A zinc-iron alloy coating was electroplated on a polished steel plate (50×150×0.3 mm) from a bath having each of the compositions shown in Table 2 under the plating condtions shown in Table 2, and then subjected to the same colored chromate treatment as in Example 2. The resulting products were subjected to the salt spray test in accordance with JIS. The results are shown in Table 2.

The results demonstrate that the present invention brings about such high corrosion resistance as cannot be obtained by the conventional zinc plating.

TABLE 2

| Example | 5 | 6 | 7 | 8 | 9 |
|---|---|---|---|---|---|
| Zinc (g/liter) | 4 | 7 | 25 | 25 | 35 |
| Sodium hydroxide (g/liter) | 32 | 35 | 140 | 170 | 250 |
| Iron (g/liter) | 0.05 | 0.03 | 2.5 | 4.5 | 4.0 |
| Chelating agent (g/liter) (*1) | (a) 5 (b) 5 | (a) 10 (b) 2 | (b) 5 (c) 60 | (b) 2 (c) 60 | (b) 5 (c) 90 |
| Brightening agent (*2) | (A) 3 g/l (C) 0.1 g/l | (B) 3 g/l (C) 0.1 g/l | (D) 8 cc/l | (D) 8 cc/l | (D) 12 cc/l |
| pH | 13.2 | 13.4 | 14 | 14 | 14 |
| Plating temperature (°C.) | 35 | 20 | 15 | 20 | 32 |
| Average cathode current density (A/dm$^2$) | 13.0 | 7.0 | 1.5 | 3 | 2 |
| Iron content of the electrodeposited coating (%) | 0.03 | 0.05 | 8.9 | 17.1 | 19.5 |
| Type of the chromate coating | Bright | Bright | Black gray | Black gray | Black gray |
| Corrosion resistance (*3) | 288 | 360 | 1440 | 960 | 744 |

(*1):
(a) sodium gluconate
(b) thiourea
(c) triethanolamine
(*2):
(A) the reaction product of ethylenediamine and epichlorohydrin
(B) the reaction product of triethylenetetramine and epichlorohydrin
(C) vanillin
(D) K-0821
(*3): The time in hours required until red rust occurred in the salt spray test. (Electrodeposited coating thickness, 5 micrometers)

What is claimed is:

1. A method for electroplating a zinc-iron alloy from an alkaline cyanide-free bath which comprises electroplating a zinc-iron alloy on a metal surface from an alkaline cyanide-free zinc plating bath having a pH of at least 13.0 and containing 0.02 to 5 g/liter of iron solubilized with a chelating agent, thereby to form on the metal surface a zinc-iron alloy layer having excellent corrosion resistance containing 0.02 to 20% of iron based on the total weight of the deposited metal.

2. A method for electroplating a zinc-iron alloy from an alkaline cyanide-free bath which comprises electroplating a zinc-iron alloy on a metal surface from an alkaline cyanide-free zinc plating bath having a pH of at least 13.0 and containing 0.02 to 5 g/liter of iron solubilized with a chelating agent and 0.1 to 5 g/liter of a brightening agent, thereby to form on the metal surface a zinc-iron alloy layer having excellent corrosion resistance containing 0.02 to 20% of iron based on the total weight of the deposited metal.

3. The method of claim 2 wherein the brightening agent is a mixture of an aromatic aldehyde with the reaction product of an amine and an epihalohydrin.

4. The method of claim 1 or 2 wherein the solubilized iron is derived from iron hydroxide, iron sulfate, iron chloride, iron phosphate, iron oxalate or iron citrate.

5. The method of claim 1 or 2 wherein the chelating agent is a hydroxycarboxylic acid salt, an aminoalcohol, a polyamine, an aminocarboxylic acid salt, a polyhydric alcohol or thiourea.

6. A method of claim 1 or 2 wherein the plating bath comprises from 3 to 40 g/liter of zinc and from 30 to 280 g/liter of an alkali hydroxide.

7. The method of claim 1 or 2 wherein the plating bath comprises from 3 to 13 g/liter of zinc and from 30 to 130 g/liter of an alkali hydroxide.

8. The method of claim 1 or 2 wherein the plating bath comprises from 20 to 40 g/liter of zinc and from 140 to 180 g/liter of an alkali hydroxide.

9. The method of claim 1 or 2 wherein the zinc-iron alloy is electrodeposited at a temperature of from 10° to 35° C. and at a current density of from 0.1 to 15 $A/dm^2$.

* * * * *

UNITED STATES PATENT AND TRADEMARK OFFICE

CERTIFICATE OF CORRECTION

PATENT NO. : 4,581,110

DATED : April 8, 1986

INVENTOR(S) : TOSHIHIKO TSUCHIDA, ET AL.

It is certified that error appears in the above-identified patent and that said Letters Patent is hereby corrected as shown below:

IN THE CLAIMS

Claim 6, line 1, (column 8, line 8),
delete "A", insert --The--.

Signed and Sealed this

*First* Day of *July 1986*

[SEAL]

*Attest:*

DONALD J. QUIGG

*Attesting Officer*

*Commissioner of Patents and Trademarks*